US007381155B2

(12) United States Patent
Chuang et al.

(10) Patent No.: US 7,381,155 B2
(45) Date of Patent: Jun. 3, 2008

(54) WRIST EXERCISER WITH AUXILIARY STARTING FORCE

(76) Inventors: Yun Yu Chuang, 7F., No. 25, Alley 8, Lane 120, Guangrong Rd., Lujhou City, Taipei County 247 (TW); Ming Hung Lin, 4F., No. 55, Sec. 2, Jhongsiao Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 11/723,424

(22) Filed: Mar. 20, 2007

(65) Prior Publication Data

US 2008/0026915 A1 Jan. 31, 2008

(30) Foreign Application Priority Data

Jul. 31, 2006 (TW) ..... 95213483 U

(51) Int. Cl.
*A63B 23/14* (2006.01)
*A63B 21/045* (2006.01)

(52) U.S. Cl. ..... 482/45; 482/127

(58) Field of Classification Search ..... 482/44–50, 482/127, 110; 446/233–235, 242, 248–249
See application file for complete search history.

(56) References Cited

U.S. PATENT DOCUMENTS 5,800,311 A * 9/1998 Chuang ..... 482/44
6,053,846 A * 4/2000 Lin ..... 482/44
6,186,914 B1 * 2/2001 Lin ..... 473/594
6,623,405 B2 * 9/2003 Chuang et al. ..... 482/44
6,629,908 B2 * 10/2003 Hamady ..... 482/45
6,770,012 B2 * 8/2004 Kuo ..... 482/44
7,033,304 B2 * 4/2006 Chuang et al. ..... 482/45
7,077,786 B2 * 7/2006 Chuang et al. ..... 482/45
7,086,990 B2 * 8/2006 Chuang et al. ..... 482/8
7,101,315 B2 * 9/2006 Chuang et al. ..... 482/44

* cited by examiner

*Primary Examiner*—Fenn C. Mathew
(74) *Attorney, Agent, or Firm*—Rosenberg, Klein & Lee

(57) ABSTRACT

A wrist exerciser includes an upper casing member and a lower casing member that are mounted to each other to enclose a rotor therebetween. The upper casing member has a top opening, which exposes a portion of the rotor. The rotor has opposite sides on which two opposite axles are mounted respectively. The axles are rotatably coupled to an outer ring. The outer ring comprises a resiliency device. The side of the rotor that faces the resiliency device is provided with a movable catching mechanism that is releasably, selectively, and operatively coupled to the resiliency device. Thus, when the rotor is initially rotated or is towed to take a linear movement by being put in contact with a fixture surface, the resiliency device builds up compression spring force, which, when the rotor is released, causes the rotor to rotate in a reversed direction and gaining auxiliary starting power and initial rotation speed. Further, the movable catching mechanism is disengageable from the resiliency device by a centrifugal force acting thereon induced by high speed rotation of the rotor so as to allow for regular operation of the wrist exerciser.

17 Claims, 11 Drawing Sheets

WRIST EXERCISER WITH AUXILIARY STARTING FORCE

BACKGROUND OF THE INVENTION

1. Field of the Invention

The present invention relates to a wrist exerciser that is in the form of a hollow sphere inside which a rotor is rotatably support so that by manually rotating the hollow sphere, the rotor is rotated inside the hollow sphere to thereby effect exercising of hand and wrist related muscles, and in particular to a wrist exerciser that is configured to auto-start the rotor by generating an initial auxiliary starting force acting on the rotor to facilitate regular operation of the wrist exerciser.

2. The Related Arts

A wrist exerciser is helpful in exercising hand and wrist related muscles, and is of particular therapeutic effect for rehabilitation. Examples are disclosed in Taiwan Patent No. 135058 and U.S. Pat. No. 5,800,311. Such devices are suitable for operating with one hand to exercise the wrist muscles. The operation of the wrist exerciser is initiated by providing an effective starting force and/or torque to a rotor inside the hollow casing and thereafter, the rotor can be further rotated with forces applied by wrist muscles. Thus, the initial starting of the rotor is an important issue for operating the wrist exerciser.

The starting of the wrist exerciser is conventionally initiated by forcibly pulling a pull rope that is wound around a circumferential groove defined in the rotor. Examples are shown in the above mentioned Taiwan and US patents. A drawback of this type of wrist exerciser is that the pull rope may easily get deviated out of the circumferential groove of the rotor, leading to incorrect and imprecise rotation of the rotor and thus failure starting of the wrist exerciser. Even when the rotor is correctly started, the rotor can gain no large starting force and initial speed.

U.S. Pat. No. 6,186,914 and Taiwan Patent No. 364383 teach a rack-and-gearing based starting mechanism for starting a wrist exerciser. Sufficient initial starting force and rotational speed can be gained by forcibly pulling the rack with respect to the rotor. However, it is difficult to mate the rack with the gearing after each time the rotor is stopped for the rotor does not always stop at a fixed angular position. A user has to adjust the relative relationship between parts of the wrist exerciser in order to allow engagement of the rack and the gearing. This is certainly troublesome. Further, the rack must be forcibly driven in order to ensure sufficient torque acting upon the rotor. This is not only difficult for certain users but may also hurt the user for the rack that is forcibly pulled may easily contact the hand of the user that holds the wrist exerciser.

US Design D464,687 discloses an electric starter that has a friction roller, which is engageable with rotor of the wrist exerciser for applying a driving force thereto. An obvious drawback is that ready engagement between the friction roller and the rotor is not easily ensured, which makes the operation difficult for certain users. In addition, the friction roller is electrically driven and, once getting in contact with a user's hand that holds the wrist exerciser, may hurt the user's hand. Further, the rotor is not maintained in a specific orbit, and this limits the driving force applied by the friction engagement to the rotor. Thus, similarly, the electric starter cannot ensure a large starting force.

Further, all the conventional wrist exerciser and/or the starting mechanism thereof are operated with two hands and are not suitable for handicapped persons that have one hand available. In addition, the precise engagement required between the conventional starting mechanism and the rotor of the wrist exerciser makes it difficult for the blind to operate the conventional wrist exercisers.

Therefore, it is desired to provide a wrist exerciser that is provided with an auxiliary starting force for efficiently and easily starting the operation of the wrist exerciser with either both hands or a single hand so as to overcome the drawbacks of the conventional devices.

SUMMARY OF THE INVENTION

Thus, an objective of the present invention is to provide a wrist exerciser that comprises a rotor that can be initially rotated by a user's finger or by being towed with respect to a fixture surface with which the rotor is put in friction engagement so that a compression spring force is built up, and when the rotor is released, the compression spring force causes the rotor to rotate in a reversed direction with a large initial torque and speed and thus ensuring the rotor with an enhanced initial power and speed.

Another objective of the present invention is to provide a wrist exerciser that can initiate an auxiliary starting power and initial speed for effecting precise and correct starting of the wrist exerciser.

A further objective of the present invention is to provide a wrist exerciser that can be operated with one single hand and that can be operated without visual feedback so that the wrist exerciser can be used by the blind and the one-hand handicapped.

To realize the objectives, in accordance with the present invention, a wrist exerciser comprises an upper casing member and a lower casing member that are mounted to each other to enclose a rotor therebetween. The upper casing member has a top opening, which exposes a portion of the rotor. The rotor has opposite sides on which two opposite axles are mounted respectively. The axles are rotatably coupled to an outer ring. The outer ring comprises a resiliency device. The side of the rotor that faces the resiliency device is provided with a movable catching mechanism that is releasably, selectively, and operatively coupled to the resiliency device. Thus, when the rotor is initially rotated or is towed to take a linear movement by being put in contact with a fixture surface, the resiliency device builds up compression spring force, which, when the rotor is released, causes the rotor to rotate in a reversed direction and gaining auxiliary starting power and initial rotation speed. Further, the movable catching mechanism is disengageable from the resiliency device by a centrifugal force acting thereon induced by high speed rotation of the rotor so as to allow for regular operation of the wrist exerciser. Thus, precise, safe, and single-handed starting operation of the wrist exerciser can be effected without any visual feedback.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
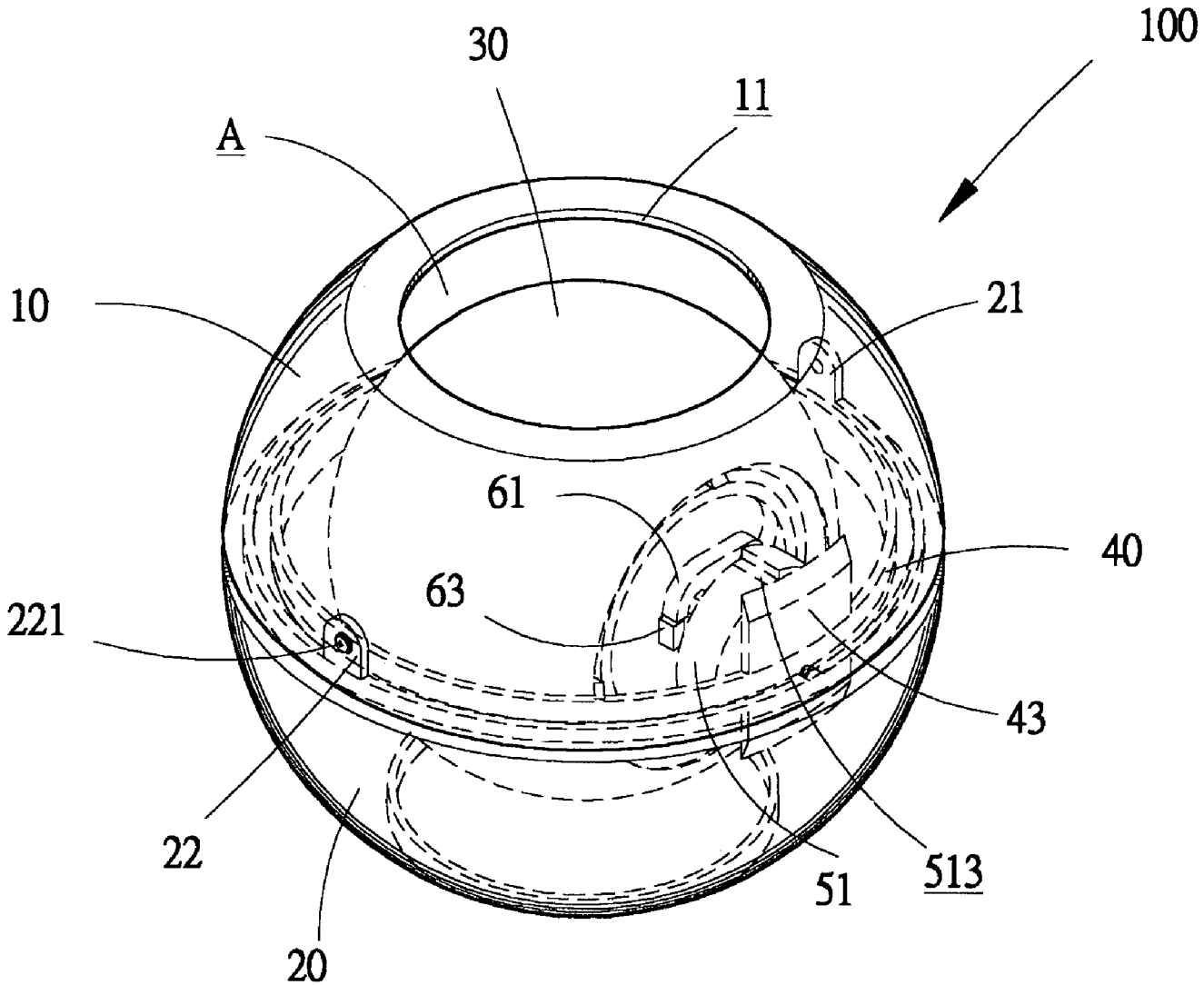
FIG. 1 is a perspective view of a wrist exerciser constructed in accordance with a first embodiment of the present invention.
Figure 2:
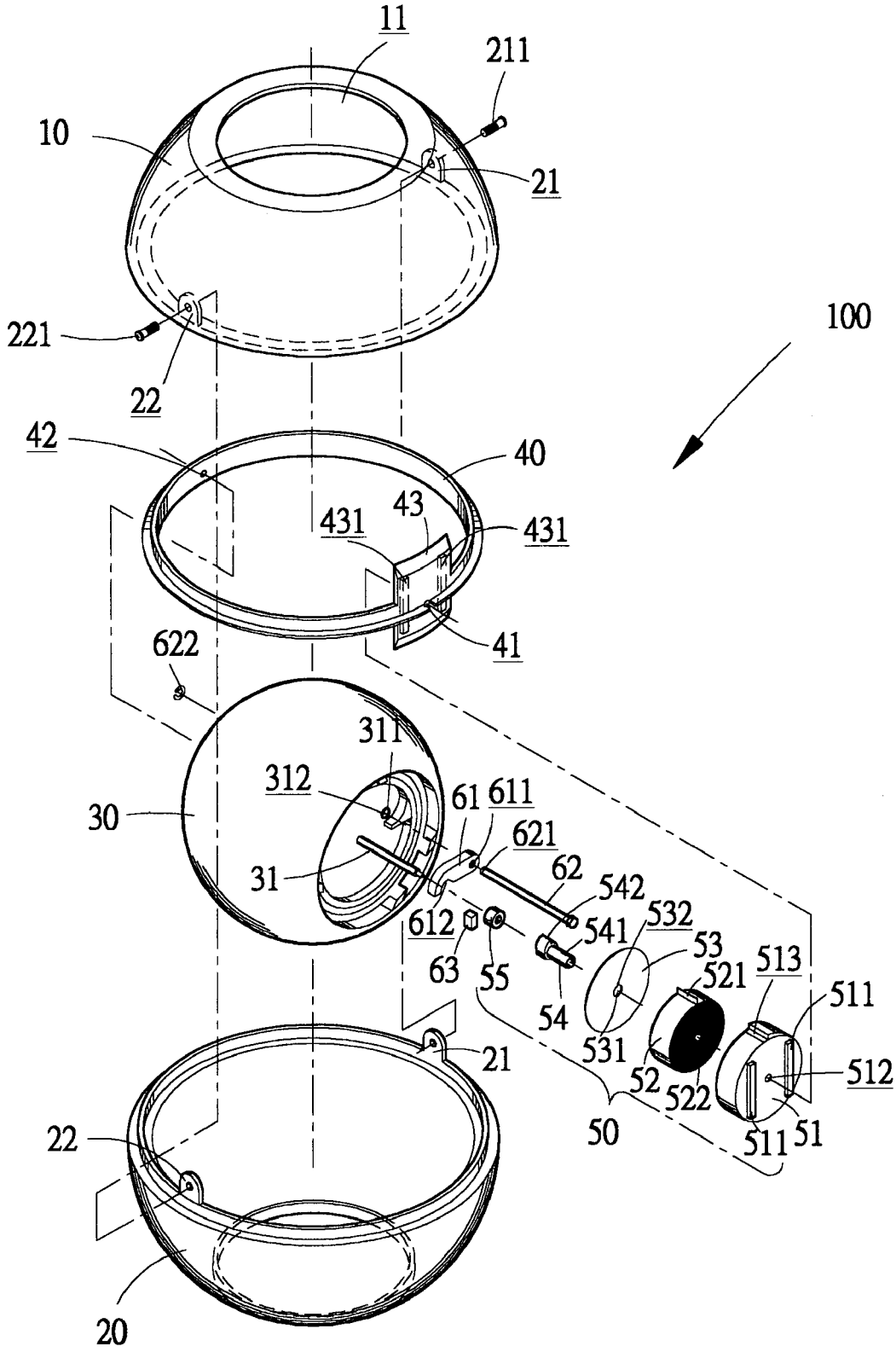
FIG. 2 is an exploded view of the wrist exerciser shown in FIG. 1.
Figure 3:
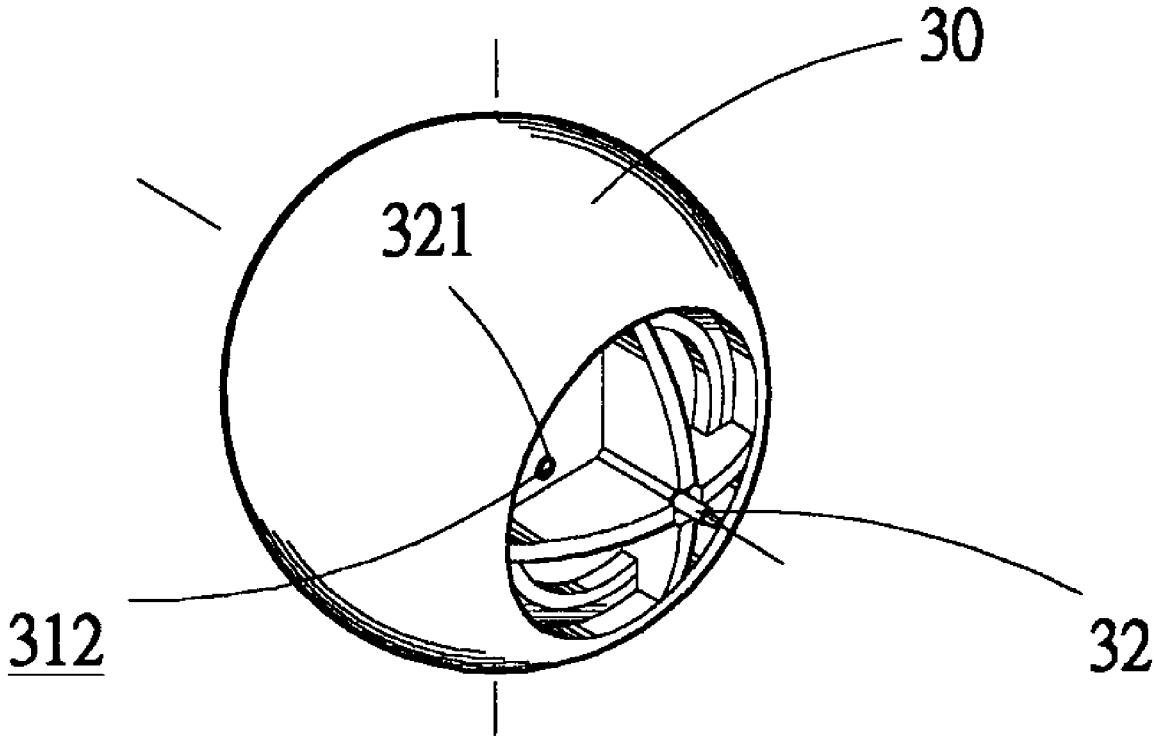
FIG. 3 is a perspective view of a rotor of the wrist exerciser, taken in a different angle.

With reference to the drawings and in particular to FIGS. 1-3, a wrist exerciser constructed in accordance with a first embodiment of the present invention, generally designated with reference numeral 100, is shown. The wrist exerciser 100 comprises an upper casing member 10 and a lower casing member 20, both being hollow members, preferably in the form of hemisphere. The upper and lower casing members 10, 20 are releasably secured to each other to form a sphere. The upper casing member 10 forms an opening 11 at an apex point thereof and also forms two slots 12, 13 in a lower circuit flange thereof. The lower casing member 20 forms two lugs 21, 22 at an upper circular flange. The slots 12, 13 of the upper casing member 10 are respectively and receivingly engageable with the lugs 21, 22 of the lower casing member 20 and are secured together by bolts 211, 221 extending through both of them whereby the upper casing member 10 and the lower casing member 20 are releasably mounted together to define therebetween a receiving space A. It is apparent that the upper and lower casing members 10, 20 can be fixed together with any known and suitable means of which the combination of slots 12, 13 and the lugs 21, 22 is just one non-limiting example.

A rotor 30 forms axially-aligned axles 31, 32 on opposite sides thereof. Two connectors 311, 321 are formed on the two sides of the rotor 30, respectively. A bore 312 extends through the connectors 311, 321 on the two sides of the rotor 30, see FIGS. 2 and 3.

A ring 40 is arranged along the upper circular flange of the lower casing member 20. Two diametrically aligned holes 41, 42 are defined in the ring. A retention member 43 is formed on an inner circumference of the ring 40 corresponding to the hole 41. Two slots 431 are defined in the retention member 43.

Figure 4:
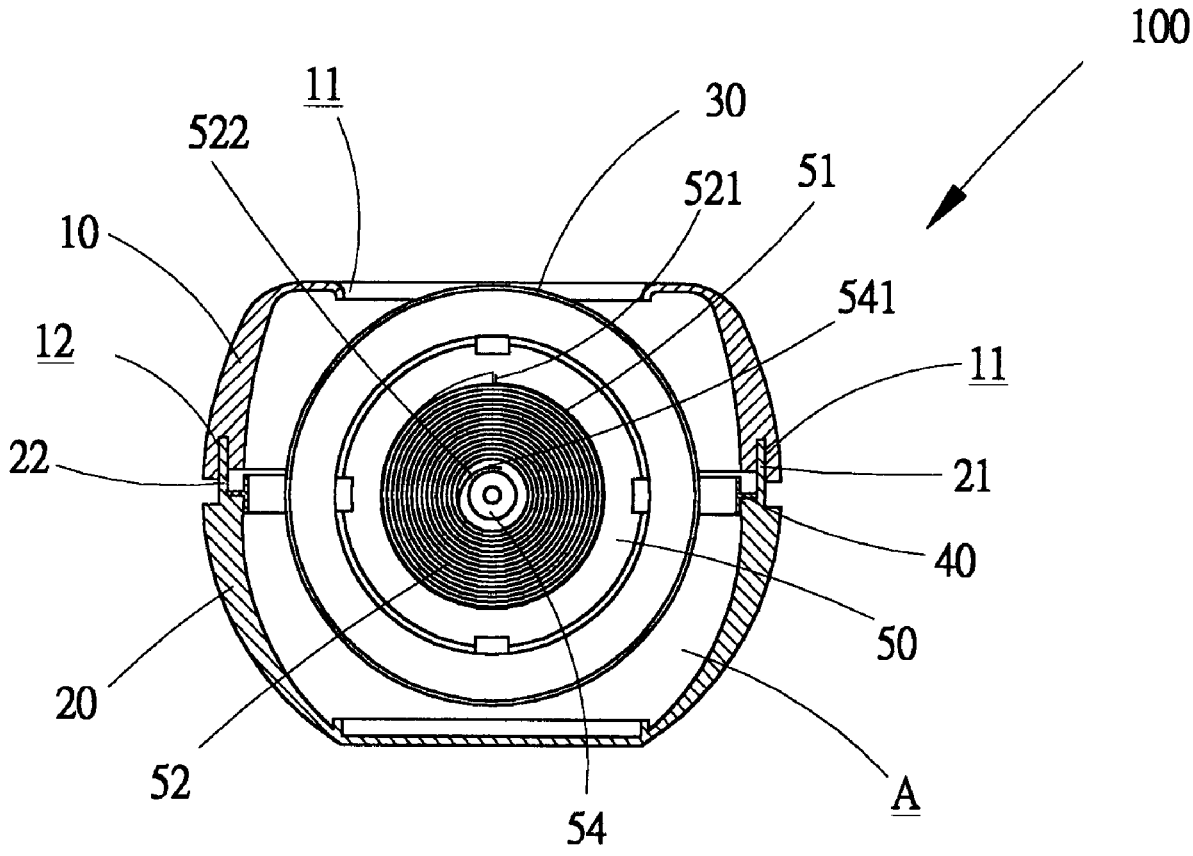
FIG. 4 is a cross-sectional view of the wrist exerciser, illustrating the structure of a resiliency device thereof.

Also referring to FIG. 4, a resiliency device 50 comprises a case 51, a resilient element 52, a lid 53, a drive shaft 54, and a bearing 55. The case 51 has an end surface on which two ribs 511 are formed. The ribs 511 are sized and located to fit into the slots 431 defined in the retention member 43 of the ring 40 to attach the case 51 to the ring 40. In a central location of the end surface of the case 51, a hole 512 is defined to align with the hole 41 of the ring 40. An opening 513 is defined in a circumferential wall of the case 51.

The resilient element 52 is received in the case 51. The resilient element 52 is not limited to any specific type and a coil compression spring is taken as an example in the illustration here of the present invention. The resilient element 52 has a first end 521, which is in the form of a hook to engage the side opening 513 of the case 51. The resilient element 52 also has a second end 522 is substantially located at a-center of the resilient element 52.

The lid 53 is attached to the case 51 to close the case 51 and thus securing the resilient element 52 inside the case 51. The lid 53 defines, substantially at a center thereof, a through hole 531 having a circumference in which a notch 532 is formed.

The drive shaft 54 is a hollow shaft having two opposite ends respectively mounted to a fixed block 541 and a driving block 542. An end of the drive shaft 54 extends through the through holes 531 of the lid 53, with the fixed block 541 passing through the notch 532, into the case 51 and is put into driving engagement with the second end 522 of the resilient element 52 so that the resilient element 52 is in operative coupling with the drive shaft 54. The bearing 55 is fit on an end of the drive shaft 54.

The axle 31 of the rotor 30 extends through the bearing 55 and into the interior of the hollow drive shaft 54 and further extending through the hole 512 of the case 51 to enter the hole 41 of the ring 40. Another axle 32 of the rotor 30 is received in the hole 42 of the ring 40. Thus, the rotor 30 is rotatably fixed to the ring 40 and is located in the receiving space A formed between the upper casing member 10 and the lower casing member 20, with the rotor 30 being partially exposed through the top opening 11 of the upper casing member 10.

Figure 5:
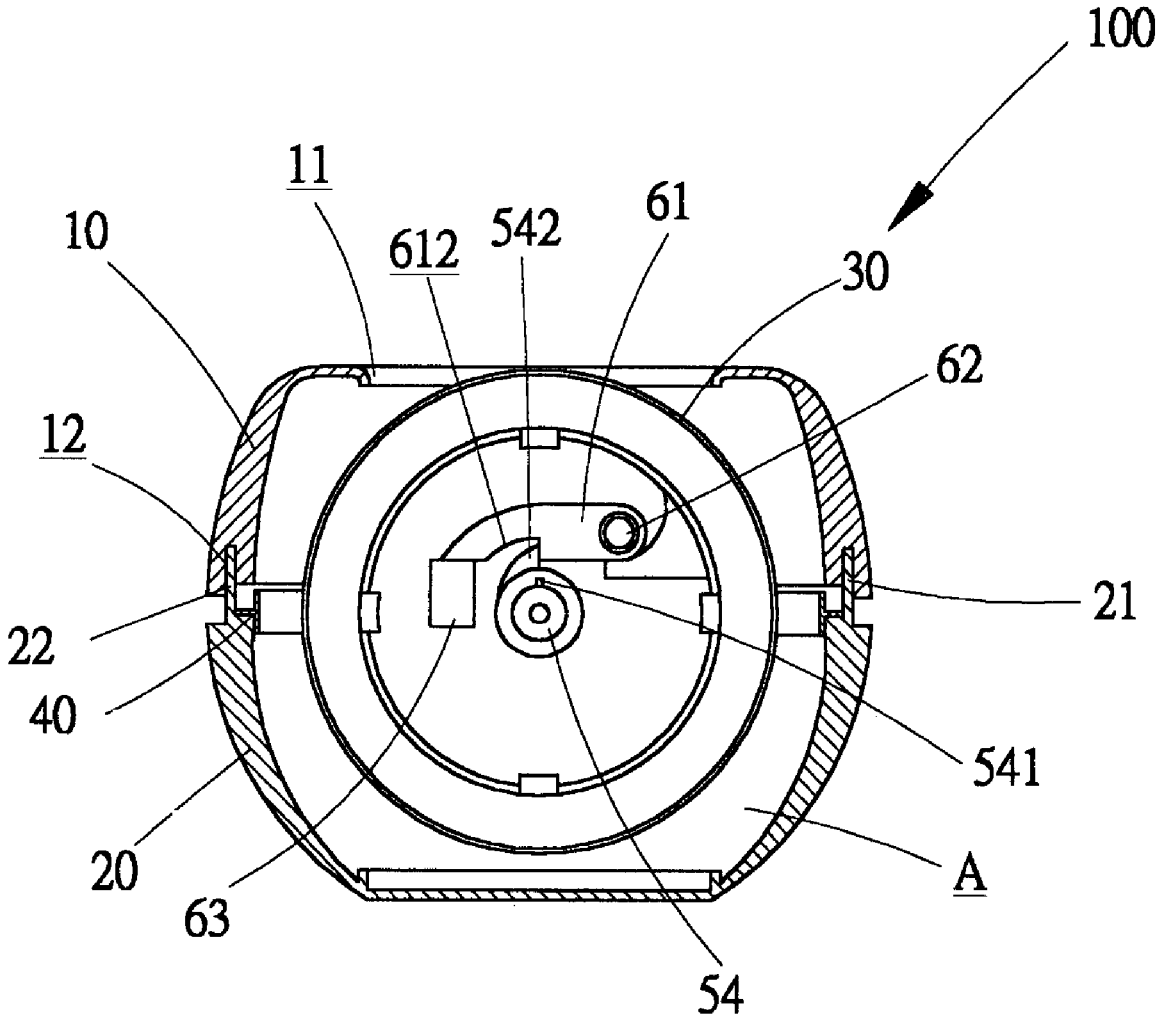
FIG. 5 is a cross-sectional view of the wrist exerciser, illustrating the structure of a movable catching mechanism thereof.

Also referring to FIG. 5, a movable catching mechanism 60 comprises an arm 61, a shaft 62 and at least one positioning element 63. The arm 61 is made of magnetically conductive metal or magnet plate. A hole 611 and the a notch 612 are respectively defined in opposite ends of the arm 61. The hole 611 is aligned with the connector 311 of the rotor 30 and the notch 612 engages the driving block 542 of the drive shaft 54 of the resiliency device 50. The shaft 62 forms, at an end thereof, a circumferential groove 621. With the shaft 62 extending through the hole 611 and the bore 312, a C-clip engages the circumferential groove 621 of the shaft 62 to rotatably fix the arm 61 to the connector 311 in restricted rotation within a predetermined angular range.

The positioning element 63 is arranged on the rotor 30 at a location in a rotation trace of the arm 61. The positioning element 63 is made of a magnet or a magnetically conductive metal so that the positioning element 63 can attract and thus fix the arm 61 when the rotor 30 is stationary or in low speed rotation. Thus, the arm 61 can be maintained in a coupling with the drive shaft 54 when the rotor 30 is stationary or in low speed rotation. However, it is apparent that the coupling between the arm 61 and the positioning element 63 is not limited to the magnetic attraction discussed above and can be replaced by any suitable means.

The coupling between the resiliency device 50 ad the movable catching mechanism 60 is not limited to the coupling formed by the engagement between the driving block 542 of the drive shaft 54 and the notch 612 of the arm 61 and can be replaced by any other suitable means.

Figure 6:
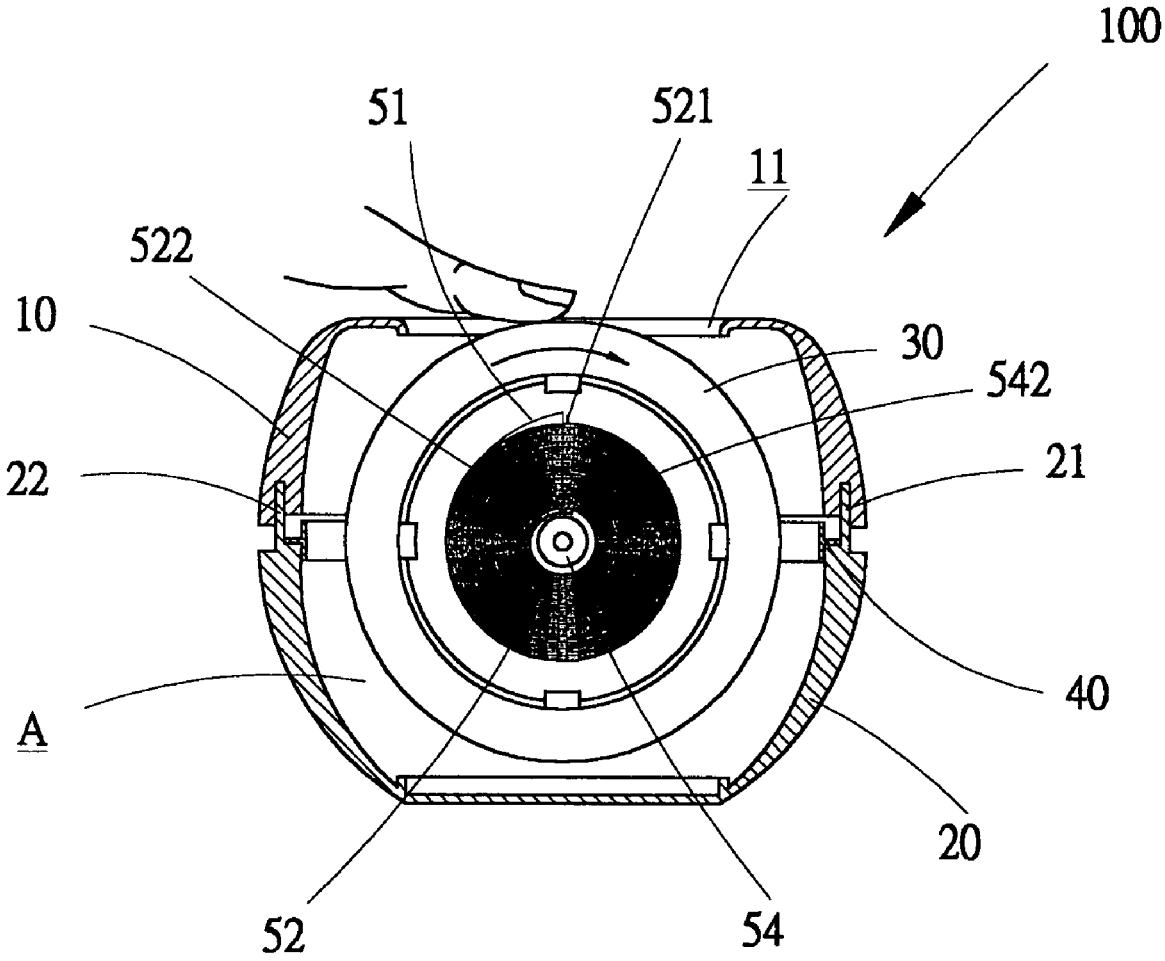
FIG. 6 is a cross-sectional view of the wrist exerciser, illustrating the operation of the wrist exerciser by rotating the rotor with a finger.

Also referring to FIG. 6, operation of the wrist exerciser 100 is illustrated. A user holds the wrist exerciser 100 with one hand and uses a finger of the other hand to contact and move the rotor 30 through the top opening 11 of the upper casing member 10. By rotating the rotor 30 in a given direction, such as counterclockwise direction as shown in FIG. 6, the arm 61 of the movable catching mechanism 60 engages and thus causes the drive shaft 54 of the resiliency to relatively rotate in an opposite direction (namely, clockwise direction in the embodiment). Thus, the fixed block 541 of the drive shaft 54 drives the resilient element 52 and thus winding and compressing the resilient element 52 so that the resilient element 52 is in possession of compressed spring force.

Figure 7:
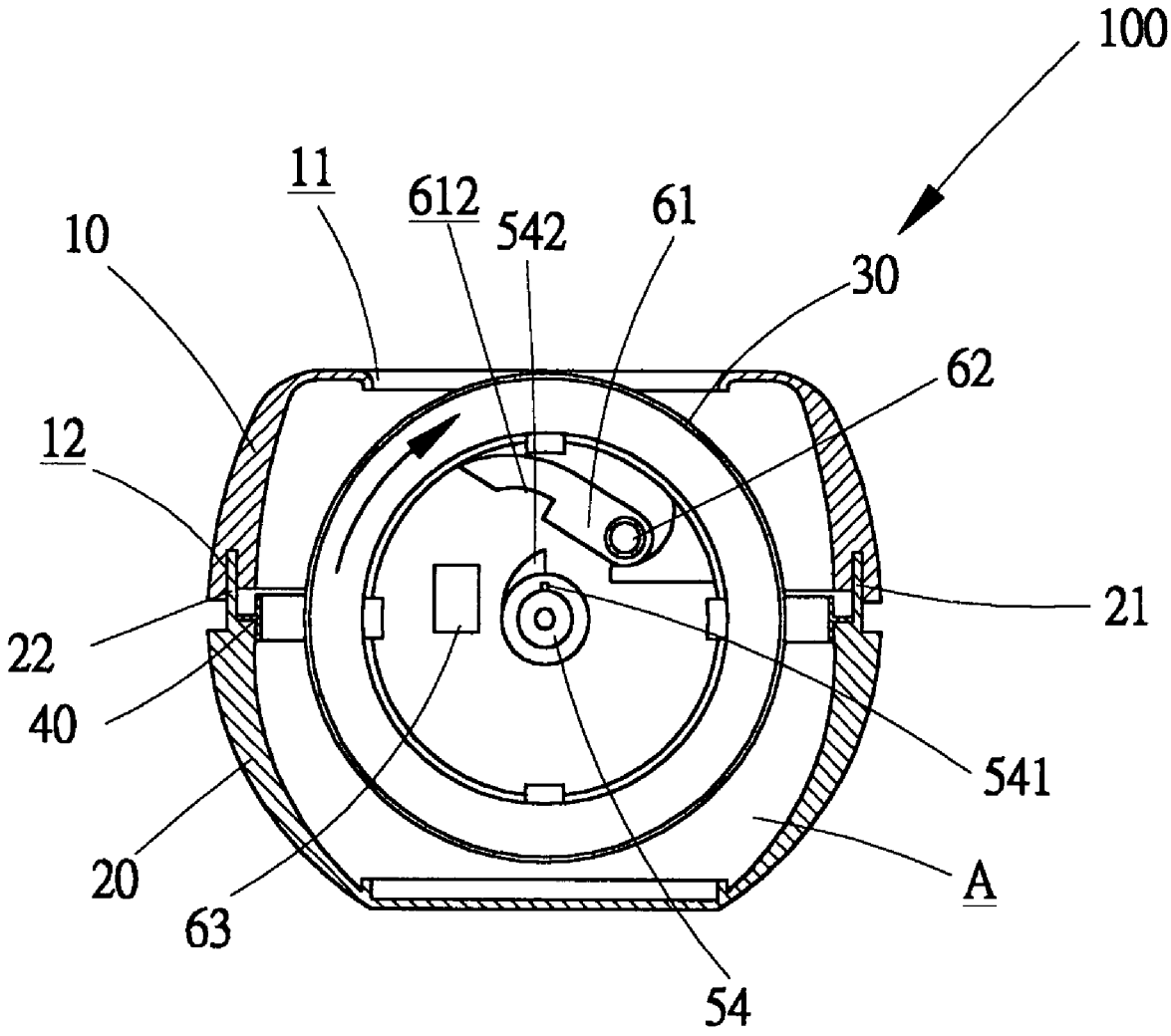
FIG. 7 is a cross-sectional view of the wrist exerciser, illustrating the condition where the movable catching mechanism is subject to a large centrifugal force and thus separated from a positioning element.

Also referring to FIG. 7, when the finger releases the rotor 30, the compressed resilient element 52 also releases the spring force, which drives the drive shaft 54 in the opposite direction, namely the clockwise direction, as indicated by arrow of FIG. 7. Through the engagement between the driving block 542 and the arm 61 of the movable catching mechanism 60, the rotor 30 is driven by the drive shaft 54 to rotate, for example in the counterclockwise direction in the embodiment illustrated, and the rotor 30 is supplied with an initial starting torque and rotation speed, which facilitate the rotor 30 to gain acceleration when the sphere of the upper and lower casing members 10, 20 is operated by the user. In other words, the rotor 30 is accelerated by the operation of the user that holds the wrist exerciser 100 with his or her hand and the auxiliary starting force ensured by the construction discussed above helps the rotor 30 to efficiently gain high speed and high torque to continuously maintain rotation.

When the rotor 30 gets high rotational speed, a centrifugal force imposed on the arm 61 is getting higher than the magnetic attraction caused by the positioning element 63, and by the centrifugal force, the arm 61 is separated from the positioning element 63 and the resiliency device 50 disengages from the movable catching mechanism 60 to allow regular rotation of the rotor 30. In this way, the conventionally used pull rope, rack and gearing device, and electrical starter are no longer needed in starting the rotor 30.

When the rotor 30 of the wrist exerciser 100 is decelerated and gets back to low speed rotation or even stationary, the centrifugal force acting on the movable catching mechanism 60 gets smaller than the magnetic attraction so that the arm 61, when rotated to pass through the positioning element 63, is re-attracted and re-secured by the positioning element 63, and the coupled condition illustrated in FIG. 5 where the resiliency device 50 is coupled to the movable catching mechanism 60 is resumed.

Figure 8:
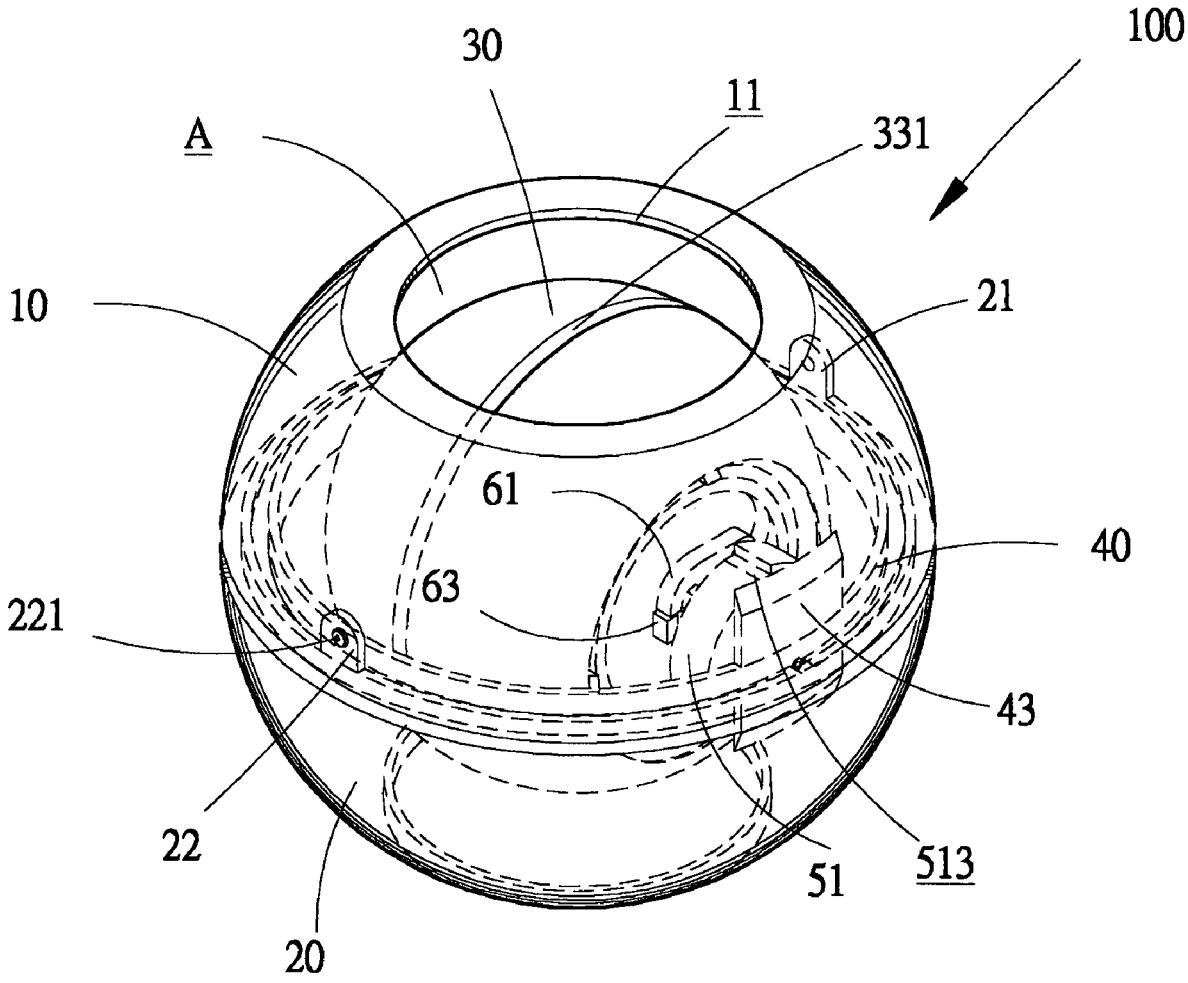
FIG. 8 is a perspective view of a wrist exerciser constructed in accordance with a second embodiment of the present invention.
Figure 9:
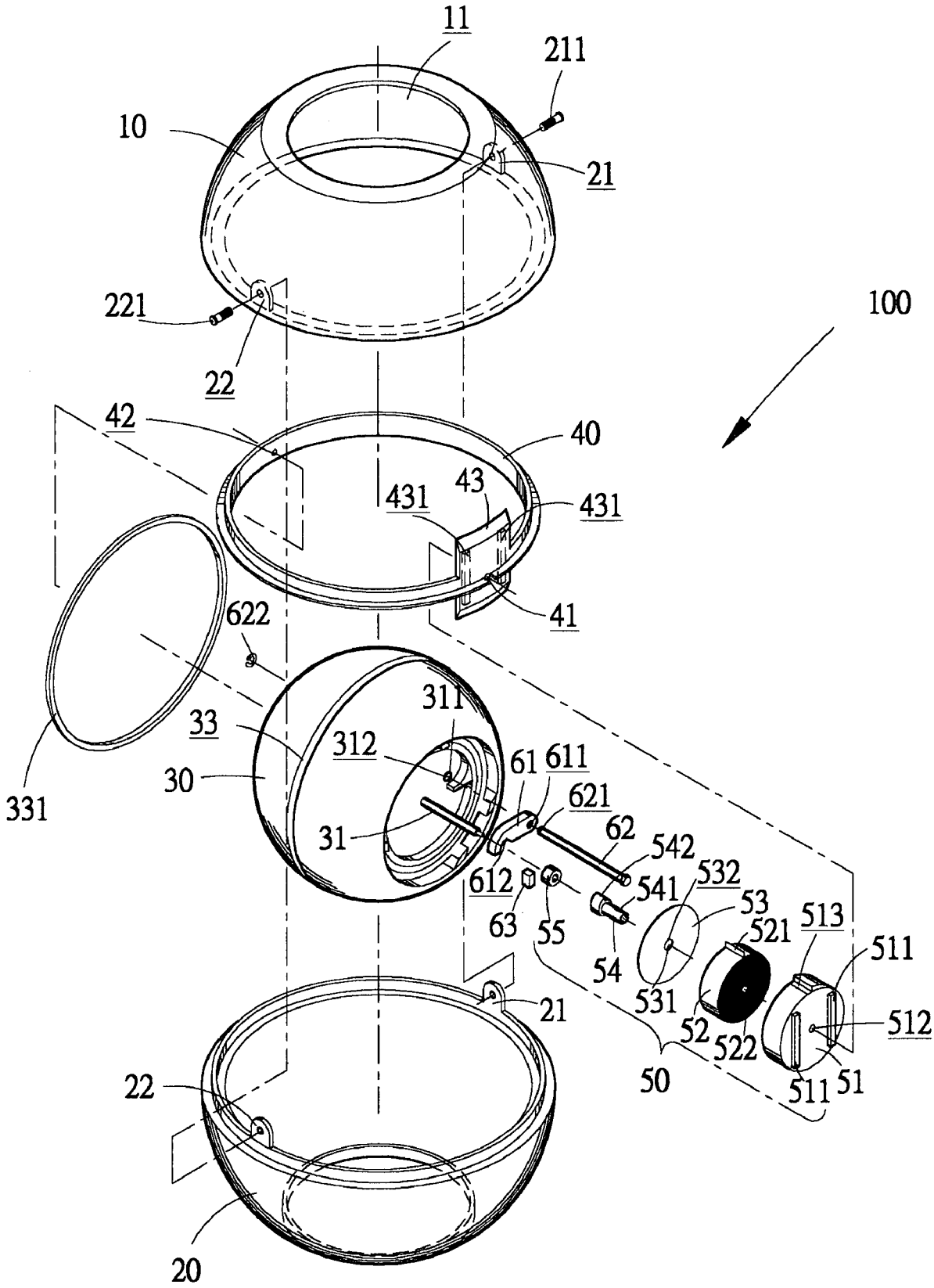
FIG. 9 is an exploded view of the wrist exerciser shown in FIG. 8.

Referring to FIGS. 8 and 9, which show a wrist exerciser in accordance with a second embodiment of the present invention; also designated with reference numeral 100 for simplicity, in the second embodiment of the wrist exerciser 100, the rotor 30 forms at least one circumferential slot 33 in which a ring 331 is fit. The ring 331 is not limited to any specific type and a rubber ring having sufficient surface friction is taken as an example of the ring 331.

Figure 10:
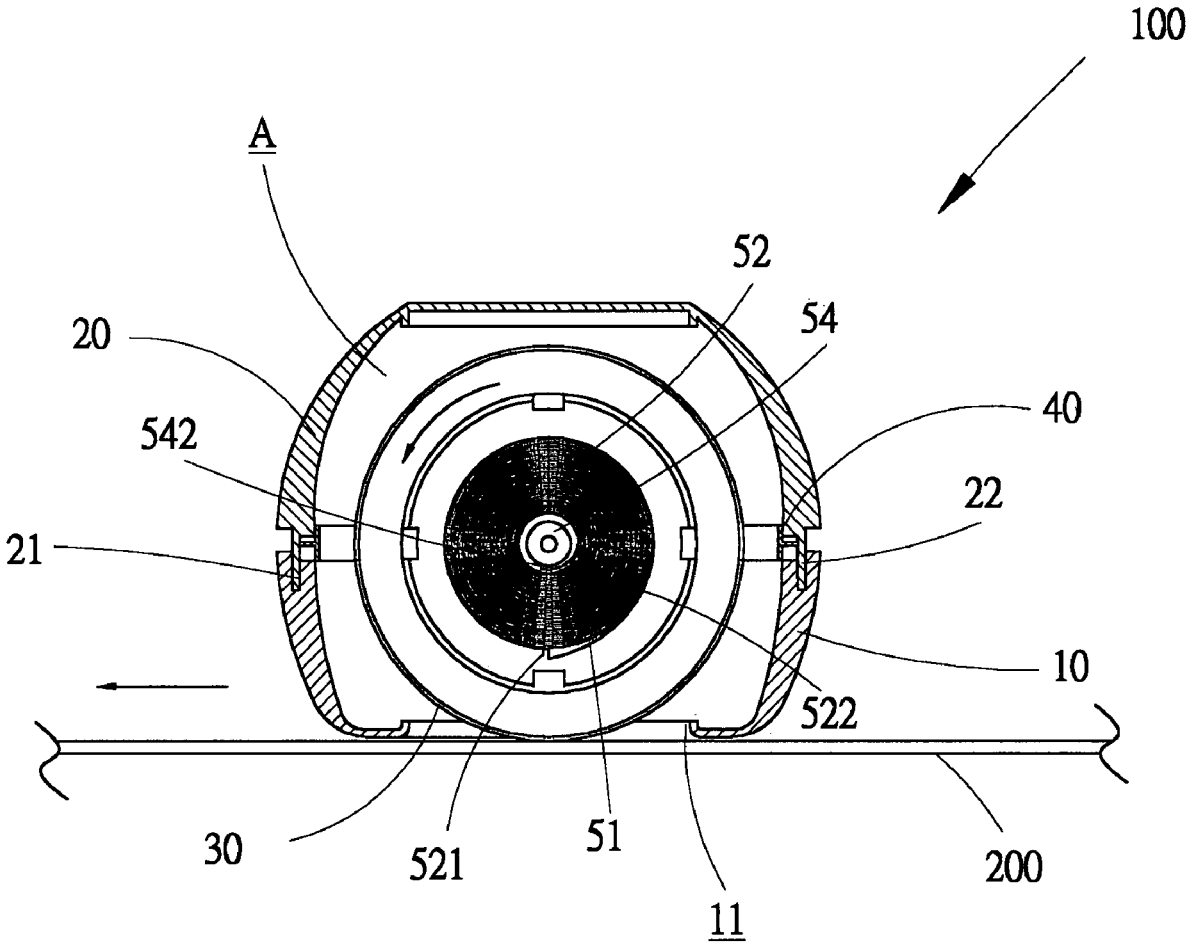
FIG. 10 illustrates operation of the wrist exerciser of the second embodiment with a single hand.

FIG. 10 illustrates the operation of the second embodiment of the wrist exerciser 100 shown in FIGS. 8 and 9. The wrist exerciser 100 is operated with a single hand. The sphere of the upper and lower casing members 10, 20 is held by the hand with the top opening 11 of the upper casing member 10 facing downward to allow a portion of the rotor 30 exposed out of the opening 11 of the upper casing member 10. The exposed portion of the rotor 30 is positioned against a fixture surface 200, such as a tabletop, ground surface or other flat surfaces and the wrist exerciser 100 is forced to move, in a linear motion, with respect to the fixture surface to cause rotation of the rotor 30, as illustrated in FIG. 10 in which the wrist exercise 100 is move leftward and the contact between the ring 331 of the rotor 30 and the fixture surface 200 ensures a friction therebetween, which in turn induces rotation of the rotor 30 in the counterclockwise direction, similar to the initial rotation driven by the user's finger demonstrated in FIG. 6 and the previous embodiment. Thus, and similar to the previous embodiment, the resilient element 52 of the resiliency device 50 is wound and compressed and build up a compression spring force so that when the wrist exerciser 100 is lifted and the rotor 30 gets off the fixture surface 200, the spring force of the resilient element 52 is released to cause an initial, clockwise rotation of the rotor 30, with which the wrist exerciser 100 of the second embodiment can effect the same operation of the previous embodiment as that illustrated in FIG. 7. The single hand operated embodiment illustrated in FIG. 10 is preferably suitable for the handicapped.

Figure 11:
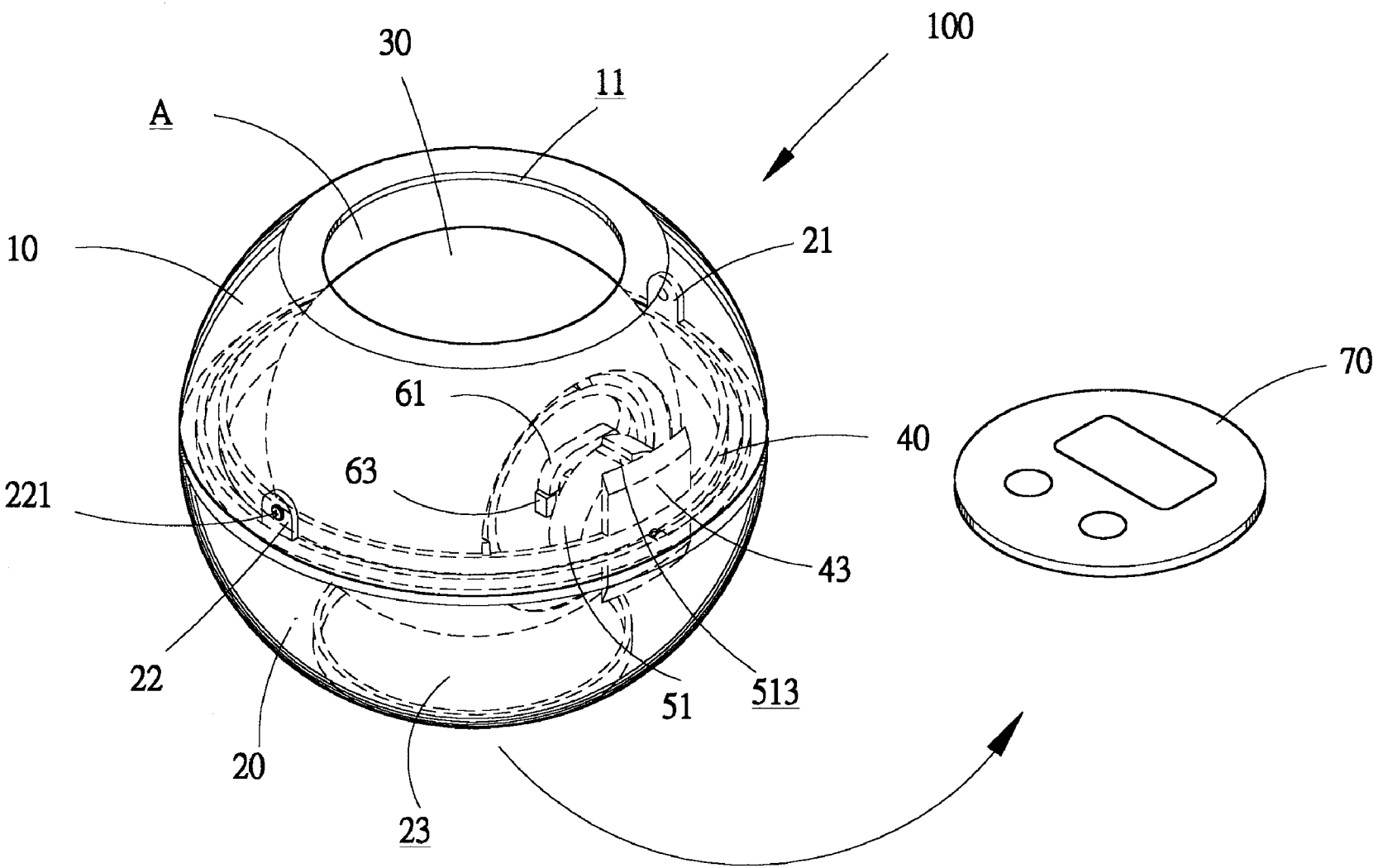
FIG. 11 is a perspective view of a wrist exerciser constructed in accordance with a third embodiment of the present invention, with a counter detached from the wrist exerciser.

FIG. 11 shows a wrist exerciser constructed in accordance with a third embodiment of the present invention, also designated with reference numeral 100 for simplicity. In the wrist exerciser 100 of the third embodiment, the lower casing member 20 defines an opening 23 in a bottom apex thereof and a counter 70 is mounted in the opening 23 for calculating the rotational speed of the rotor 30. The counter 70 comprises a display 71 to display the rotational speed of the rotor 30. The counter 70 can be of any suitable device, such as a photo-electrical counter or a magnetism based counter that operates in association with for example the positioning element 63.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A wrist exerciser, comprising:

upper and lower casing members, which are hollow members and are releasably mounted to each other to define a receiving space therebetween, the upper casing member forming an opening;

a rotor rotatably received in the receiving space between the upper and lower casing members and having opposites sides from which axles extending in opposite directions, the rotor being sized and arranged to have a portion thereof selectively exposed out of the upper casing member through the opening;

an outer ring arranged along a circular flange of the lower casing member and defining two holes to rotatably receive the axles of the rotor respectively;

a resiliency device coupled to the ring at a location corresponding to one of the holes of the ring to selectively build up and release a spring force; and a movable catching mechanism coupled to one side of the rotor and in operative coupling with the resiliency device whereby by applying a contact force to rotate the rotor, the resiliency device builds up the spring force and whereby by releasing the contact force that rotates the rotor, the resiliency device releases the spring force that acts upon the rotor to provide the rotor with an initial auxiliary starting force.

2. The wrist exerciser as claimed in claim 1, wherein the upper casing member has a circular flange in which two slots are defined.

3. The wrist exerciser as claimed in claim 1, wherein the lower casing member defines a bottom opening.

4. The wrist exerciser as claimed in claim 3 further comprising a counter mounted to the bottom opening of the lower casing member.

5. The wrist exerciser as claimed in claim 1, wherein the rotor has two opposite sides to each of which a connector is mounted.

6. The wrist exerciser as claimed in claim 5, wherein a bore is defined through the connectors.

7. The wrist exerciser as claimed in claim 1, wherein a groove is defined around the rotor.

8. The wrist exerciser as claimed in claim 7, wherein a ring is fit and fixed in the groove.

9. The wrist exerciser as claimed in claim 8, wherein the ring comprises a rubber ring.

10. The wrist exerciser as claimed in claim 1, wherein the outer ring comprises a retention member.

11. The wrist exerciser as claimed in claim 10, wherein two slots are defined in the retention member.

12. The wrist exerciser as claimed in claim 1, wherein the resiliency device comprises:

a case mounted to the outer ring and defining a hole that is aligned with the hole of the outer ring, the case having a circumferential wall in which an opening is defined;

a resilient element received in the case and having a first end in the form of a hook engageable with the opening defined in the circumferential wall of the case and a second end located at a substantially center of the resilient element;

a lid mounted to and closing the case to retain the resilient element in the case, the lid defining a through hole at a center thereof, the hole having a circumference in which a notch is defined;

a drive shaft comprising a hollow shaft and having opposite ends respectively forming a fixed block and a driving block, an end of the drive shaft extending through the through hole of the lid, with the fixed block passing through the notch to enter the case and engage the second end of the resilient element so as to operatively couple the resilient element to the drive shaft; and a bearing fit over the drive shaft.

13. The wrist exerciser as claimed in claim 12, wherein the resilient element comprises a compression coil spring.

14. The wrist exerciser as claimed in claim 1, wherein the movable catching mechanism comprises:

an arm having opposite ends in which a hole and a notch are respectively defined, the hole being aligned with and connected to one side of the rotor, the notch engaging the resiliency device;

a shaft having an end in which a circumferential groove is defined, the shaft extending through the hole of the arm and the rotor and retained by a C-clip fit in the groove so as to rotatably fix the arm to the side of the rotor; and a positioning element mounted to one side of the rotor at a trace of rotation of the arm to selectively hold the arm.

15. The wrist exerciser as claimed in claim 10, wherein two slots are defined in the retention member.

16. The wrist exerciser as claimed in claim 14, wherein the arm is made of magnetically conductive metal.

17. The wrist exerciser as claimed in claim 14, wherein the positioning element comprises a magnet.

* * * * *